US010875152B2

(12) United States Patent
Nakamura

(10) Patent No.: US 10,875,152 B2
(45) Date of Patent: Dec. 29, 2020

(54) SUPER-ABRASIVE GRINDING WHEEL

(71) Applicant: A.L.M.T. Corp., Tokyo (JP)

(72) Inventor: Nobuhide Nakamura, Kato (JP)

(73) Assignee: A.L.M.T. Corp., Tokyo (JP)

( * ) Notice: Subject to any disclaimer, the term of this patent is extended or adjusted under 35 U.S.C. 154(b) by 0 days.

(21) Appl. No.: 16/076,859

(22) PCT Filed: Nov. 28, 2016

(86) PCT No.: PCT/JP2016/085096
§ 371 (c)(1),
(2) Date: Aug. 9, 2018

(87) PCT Pub. No.: WO2017/163487
PCT Pub. Date: Sep. 28, 2017

(65) Prior Publication Data

US 2019/0039211 A1 Feb. 7, 2019

(30) Foreign Application Priority Data

Mar. 24, 2016 (JP) ..... 2016-060379

(51) Int. Cl.

| | |
|---|---|
| ***B24D 3/02*** | (2006.01) |
| ***B24D 18/00*** | (2006.01) |
| ***B24D 3/06*** | (2006.01) |
| *B24D 3/00* | (2006.01) |
| *B24D 11/00* | (2006.01) |
| *C09K 3/14* | (2006.01) |

(52) U.S. Cl.
CPC ..... *B24D 3/06* (2013.01); *B24D 18/0018* (2013.01)

(58) Field of Classification Search
USPC ..... 51/293, 307, 309
See application file for complete search history.

(56) References Cited

U.S. PATENT DOCUMENTS

| | | | | |
|---|---|---|---|---|
| 6,102,024 | A | 8/2000 | Buljan et al. | |
| 6,306,025 | B1 | 10/2001 | Torii | |
| 6,419,574 | B1 | 7/2002 | Takahashi et al. | |
| 2003/0114085 | A1 | 6/2003 | Choi et al. | |
| 2014/0349557 | A1* | 11/2014 | Mizuno | B24D 5/06 451/542 |
| 2015/0290771 | A1 | 10/2015 | Li | |

FOREIGN PATENT DOCUMENTS

| | | |
|---|---|---|
| CN | 1209471 A | 3/1999 |
| CN | 1286158 A | 3/2001 |
| CN | 1810420 A | 8/2006 |

(Continued)

OTHER PUBLICATIONS

Notification of the First Office Action issued in counterpart Chinese Patent Application No. 201680083912.7 dated Nov. 20, 2019.

*Primary Examiner* — James E McDonough
(74) *Attorney, Agent, or Firm* — Baker Botts L.L.P.; Michael A. Sartori

(57) ABSTRACT

A super-abrasive grinding wheel includes a core and a super-abrasive grain layer provided on a surface of the core, the super-abrasive grain layer including diamond abrasive grains and CBN abrasive grains, the diamond abrasive grains and the CBN abrasive grains being fixed to the core in a single layer by a binder.

6 Claims, 2 Drawing Sheets

(56) References Cited

FOREIGN PATENT DOCUMENTS

| | | | | |
|---|---|---|---|---|
| CN | 104066549 | A | | 9/2014 |
| CN | 104669138 | A | | 6/2015 |
| JP | H06-155305 | A | | 6/1994 |
| JP | H06-262527 | A | | 9/1994 |
| JP | H07-075971 | A | | 3/1995 |
| JP | 07-237128 | A | | 9/1995 |
| JP | 07237128 | A | * | 9/1995 |
| JP | H09-011133 | A | | 1/1997 |
| JP | H11-277440 | A | | 10/1999 |
| JP | 2001-246560 | A | | 9/2001 |
| JP | 2002-172554 | A | | 6/2002 |
| JP | 2002-178265 | A | | 6/2002 |
| JP | 2003-525130 | A | | 8/2003 |
| JP | 2004-181597 | A | | 7/2004 |
| JP | 2006-026809 | A | | 2/2006 |
| JP | 2008-200780 | A | | 9/2008 |
| JP | 2013-111707 | A | | 6/2013 |
| JP | 2013-146817 | A | | 8/2013 |
| JP | 2015-009325 | A | | 1/2015 |
| WO | 99/46077 | A2 | | 9/1999 |

* cited by examiner

SUPER-ABRASIVE GRINDING WHEEL

TECHNICAL FIELD

The present invention relates to a super-abrasive grinding wheel. The present application claims priority based on Japanese Patent Application No. 2016-060379 filed on Mar. 24, 2016. The Japanese patent application is entirely incorporated herein by reference. More particularly, the present invention relates to a super-abrasive grinding wheel having diamond abrasive grains and cubic boron nitride (CBN) abrasive grains.

BACKGROUND ART

Conventionally, tools having diamond abrasive grains and CBN abrasive grains are disclosed for example in Japanese Patent Laying-Open Nos. 06-262527, 2008-200780, 2013-146817, 2015-009325, 2002-178265, 06-155305, 07-075971, and 11-277440 (PTDs 1, 2, 3, 4, 5, 6, 7, and 8, respectively).

CITATION LIST

Patent Documents

PTD 1: Japanese Patent Laying-Open No. 06-262527
PTD 2: Japanese Patent Laying-Open No. 2008-200780
PTD 3: Japanese Patent Laying-Open No. 2013-146817
PTD 4: Japanese Patent Laying-Open No. 2015-009325
PTD 5: Japanese Patent Laying-Open No. 2002-178265
PTD 6: Japanese Patent Laying-Open No. 06-155305
PTD 7: Japanese Patent Laying-Open No. 07-075971
PTD 8: Japanese Patent Laying-Open No. 11-277440

SUMMARY OF INVENTION

A super-abrasive grinding wheel according to the present invention comprises a core and a super-abrasive grain layer provided on a surface of the core. The super-abrasive grain layer includes diamond abrasive grains and CBN abrasive grains, and the diamond abrasive grains and the CBN abrasive grains are fixed to the core in a single layer by a binder.

As the super-abrasive grinding wheel thus configured has diamond abrasive grains and CBN abrasive grains fixed to the core in a single layer by a binder, the diamond abrasive grains and the CBN abrasive grains complement each other and thus allow long tool life.

DETAILED DESCRIPTION

Problem to be Solved by the Present Disclosure

In conventional art, there is a problem of short tool life depending on the type of the workpiece, the processing condition(s), and the tool's specification.

Accordingly, the present invention has been made to solve the above problem. An object of the present invention is to provide a super-abrasive grinding wheel having a long tool life.

Advantageous Effect of the Present Disclosure

The present invention can provide a super-abrasive grinding wheel having a long life.

DESCRIPTION OF EMBODIMENTS

Initially, embodiments of the present invention will be enumerated and described.

1. Configuration of Super-Abrasive Wheel 1

Figure 1:
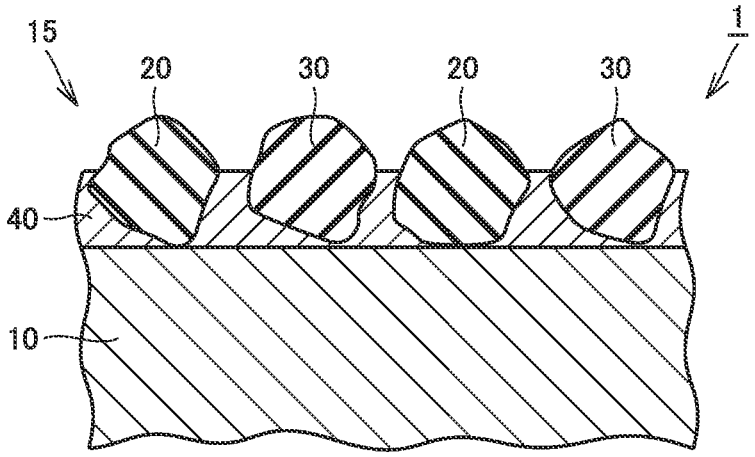
FIG. 1 is a cross-sectional view of a portion of a super-abrasive grinding wheel according to an embodiment.

FIG. 1 is a cross-sectional view of a portion of a super-abrasive grinding wheel according to an embodiment. As shown in FIG. 1, a super-abrasive grinding wheel 1 includes a core 10 and a super-abrasive grain layer 15 provided on a surface of the core. Super-abrasive grain layer 15 includes super-abrasive grains (diamond abrasive grains 20 and CBN abrasive grains 30), and diamond abrasive grains 20 and CBN abrasive grains 30 are fixed to core 10 in a single layer by a binder 40.

Super-abrasive grinding wheel 1 is used to grind tool steel, high speed steel, various types of alloy steels, hardened steel and other similar metal materials, Ni, Co based superalloy and heat resistant alloy, cemented carbide, cermet, semiconductor materials, ceramics, carbon, rubber, resin, GFRP (Glass fiber reinforced plastics) and other various types of materials.

Core 10 is a member for supporting super-abrasive grain layer 15. Core 10 is composed of ceramics, cemented carbide, aluminum, steel or similar metal. Core 10 may be composed of a single material or may be composed of a plurality of materials.

It is observed that the cutting edge of diamond abrasive grains 20 is mainly abraded and thus worn. In contrast, it is observed that the cutting edge of CBN abrasive grains 30 is mainly crushed and thus worn (significantly crushed and thus worn depending on the grinding condition). When diamond abrasive grains 20 and CBN abrasive grains 30 fixed in a single layer by binder 40 are compared with CBN abrasive grains 30 alone fixed in a single layer by binder 40, the former can have diamond abrasive grains 20 effectively acting to prevent CBN abrasive grains 30 from being excessively crushed and significantly crushed. If diamond abrasive grains 20 and CBN abrasive grains 30 are fixed in a state which is not a single layer, CBN abrasive grains 30 easily, excessively, finely crushed, and significantly crushed.

Most preferably, diamond abrasive grains 20 and CBN abrasive grains 30 are fixed in a single layer by binder 40, with diamond abrasive grains 20 scattered in the structure of super-abrasive grinding wheel 1 mainly including CBN abrasive grains 30. This can suppress excessive, fine crushing and significant crushing of CBN abrasive grains 30. As a result, it is believed that the grinding wheel can be less worn. Most preferably, the diamond abrasive grains added to the CBN abrasive grains are uniformly dispersed.

Super-abrasive grinding wheel 1 of this embodiment is a super-abrasive grinding wheel in which diamond abrasive grains 20 and CBN abrasive grains 30 are fixed in a single layer by binder 40. Diamond abrasive grains 20 and CBN abrasive grains 30 are fixed by electroplating or chemical plating to a surface of core 10 such as steel, cemented carbide, aluminum alloy or the like processed into a required shape.

Electroplating is a production method in which an appropriate current is passed in an electrolytic solution between a core serving as a negative electrode and a nickel plate serving as a positive electrode to cause a nickel layer to deposit on a surface of the core to fix super-abrasive grains. Chemical plating is a production method in which, by a reducing agent contained in a plating solution, nickel ions are reduced and thus precipitated to fix super-abrasive grains. It is also called electroless plating.

Figure 2:
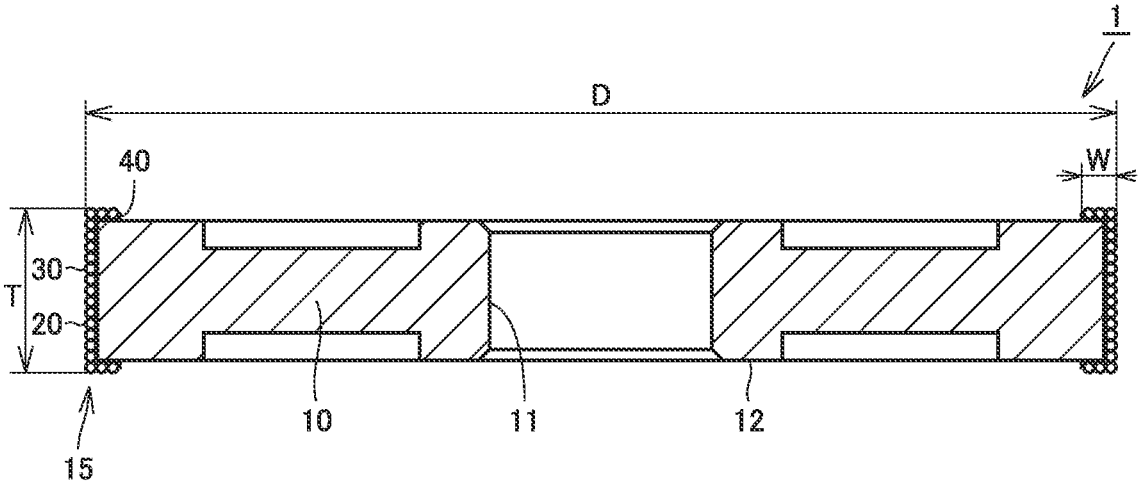
FIG. 2 is a cross-sectional view showing an overall configuration of a super-abrasive grinding wheel (a flat grinding wheel) having a super-abrasive grain layer as shown in FIG. 1.

FIG. 2 is a cross-sectional view showing an overall configuration of a super-abrasive grinding wheel (a flat grinding wheel) having a super-abrasive grain layer as shown in FIG. 1. As shown in FIG. 2, core 10 of super-abrasive grinding wheel 1 has a boss portion 12. Boss portion 12 is provided with a through hole 11. While FIG. 2 shows super-abrasive grinding wheel 1 as a flat grinding wheel, super-abrasive grinding wheel 1 may be a formed grinding wheel and a cup grinding wheel.

2. Average Grain Diameter Ratio of Diamond Abrasive Grains 20 and CBN Abrasive Grains 30 in Super-Abrasive Grain Layer 15

Diamond abrasive grains 20 and CBN abrasive grains 30 preferably have an average grain diameter ratio ((diamond abrasive grains' average grain diameter)/(CBN abrasive grains' average grain diameter)) of 50 to 110%.

If the ratio is less than 50%, diamond abrasive grains 20 may be too small to exhibit the above-described function of diamond abrasive grains 20. If the ratio exceeds 110%, diamond abrasive grains 20 have a larger average grain diameter than CBN abrasive grains 30, and diamond abrasive grains 20 mainly come in contact with the workpiece. This may result in the workpiece having a coarse surface.

It should be noted that the word "may" indicates that there is a slight possibility, and does not mean that there is high probability.

(Method of Controlling Average Grain Diameter of Super-Abrasive Grains)

Diamond abrasive grains 20 and CBN abrasive grains 30 obtained from an abrasive grain maker (for example, Tomei Diamond Co., Ltd.) are extracted by a predetermined mass and a laser diffraction type grain size distribution measurement device (for example, SALD series produced by Shimadzu Corporation) can be used to measure an average grain diameter of super-abrasive grains (or a source material). The average grain diameter of diamond abrasive grains 20 and CBN abrasive grains 30 of super-abrasive grinding wheel 1 can be controlled by producing super-abrasive grinding wheel 1 using super-abrasive grains (or a source material) having different average grain diameters.

(Method of Measuring Average Grain Diameter of Super-Abrasive Grains of Super-Abrasive Wheel)

In order to measure the average grain diameter of super-abrasive grinding wheel 1 completed, binder 40 of super-abrasive grain layer 15 is dissolved with an acid or the like to extract diamond abrasive grains 20 and CBN abrasive grains 30. When super-abrasive grinding wheel 1 is a large grinding wheel, super-abrasive grain layer 15 is cut by a predetermined volume (for example, 0.5 $cm^3$), and diamond abrasive grains 20 and CBN abrasive grains 30 are extracted from that portion and observed with a loupe to divide diamond abrasive grains 20 and CBN abrasive grains 30. The abrasive grains are measured with a laser diffraction type grain size distribution measurement device (for example, SALD series produced by Shimadzu Corporation) to measure an average grain diameter.

3. Mass Ratio of Diamond Abrasive Grains 20 and CBN Abrasive Grains 30 in Super-Abrasive Grain Layer 15

Super-abrasive grain layer 15 includes diamond abrasive grains 20 and CBN abrasive grains 30 preferably at a mass ratio of 1:99 to 50:50. If the mass ratio is 1:99 (1/99) or less, diamond abrasive grains 20 are reduced and may be unable to exhibit the above function by diamond abrasive grains 20. If the mass ratio exceeds 50:50 (50/50), there are too many diamond abrasive grains 20, and if the workpiece is steel, iron may react with diamond abrasive grains 20 and the grinding wheel may be significantly worn. More preferably, the mass ratio is from 3:97 to 40:60.

(Method of Controlling Mass Ratio of Super-Abrasive Grains)

Diamond abrasive grains 20 and CBN abrasive grains 30 obtained from an abrasive grain maker (for example, Tomei Diamond Co., Ltd.) are extracted to have a prescribed mass ratio. This mass ratio will be the mass ratio of diamond abrasive grains 20 and CBN abrasive grains 30 in super-abrasive grinding wheel 1 completed, and the mass ratio can thus be adjusted in a stage of preparing a source material.

(Method for Measuring Mass Ratio of Super-Abrasive Grains of Super-Abrasive Wheel)

In order to measure the mass ratio of super-abrasive grinding wheel 1 completed, binder 40 of super-abrasive grain layer 15 is dissolved with an acid or the like to extract diamond abrasive grains 20 and CBN abrasive grains 30. When super-abrasive grinding wheel 1 is a large grinding wheel, super-abrasive grain layer 15 may be cut by a predetermined volume (for example, 0.5 $cm^3$), and diamond abrasive grains 20 and CBN abrasive grains 30 may be extracted from that portion and observed with a loupe to divide diamond abrasive grains 20 and CBN abrasive grains 30 and measure the mass ratio.

(Ratio of Area of Super-Abrasive Grain Layer 15 Occupied by Diamond Abrasive Grains 20 and CBN Abrasive Grains 30)

Super-abrasive grain layer 15 is occupied in area by diamond abrasive grains 20 and CBN abrasive grains 30 at a ratio of 10% or more and 70% or less. If the occupied area ratio is less than 10%, super-abrasive grain layer 15 includes a small amount of super-abrasive grains, which may result in a reduced lifetime. If the occupied area ratio exceeds 70%, super-abrasive grain layer 15 includes too many super-abrasive grains, which may result in reduced sharpness.

Note that an occupied area ratio is defined as a ratio of an area of super-abrasive grain layer 15 occupied by super-abrasive grains per unit area, for example 1 $mm^2$, when super-abrasive grain layer 15 is observed from directly above.

In order to measure a ratio of an area occupied by diamond abrasive grains 20 and CBN abrasive grains 30, initially, electronic data of an image is obtained from an observation of a surface of super-abrasive grain layer 15 with a scanning electron microscope (SEM). Image analysis software is used to divide super-abrasive grains (diamond abrasive grains 20 and CBN abrasive grains 30) from binder 40. The super-abrasive grains' area is divided by the area of a field of view to calculate an occupied area ratio. For example, with a field of view of 1000 μm×1000 μm, an occupied area ratio is measured at any three locations, and the occupied area ratios of the three locations are averaged.

4. Binder

Binder 40 is metal-plating or a brazing material. As metal plating, nickel plating is suitable, and as the brazing material, silver solder is suitable.

As super-abrasive grinding wheel 1 thus configured has diamond abrasive grains 20 and CBN abrasive grains 30 fixed to core 10 in a single layer by binder 40, diamond abrasive grains 20 can act on a workpiece to suppress excessive, fine crushing and significant crushing of CBN abrasive grains 30. As a result, diamond abrasive grains 20 and CBN abrasive grains 30 complement each other and thus allow long tool life. A workpiece to be processed is preferably an iron-based metal and an alloy containing an iron-based metal as a main component, and what allows a significant effect to be exhibited is superalloy and heat-resistant alloy containing nickel or cobalt as a main component.

DESCRIPTION OF EMBODIMENTS

Example 1

TABLE 1

| sample nos. | superabrasive grain mixture ratio (mass %) CBN | diamond | ratio of area of superabrasive grain layer occupied by superabrasive grain mixture (%) | (diamond's average grain diameter)/(CBN's average grain diameter) (%) | type of binder | tool life |
|---|---|---|---|---|---|---|
| 1 | 99.5 | 0.5 | 10 | 100 | brazing material | C |
| 2 | 99 | 1 | 10 | 100 | brazing material | B |
| 3 | 97 | 3 | 10 | 100 | brazing material | A |
| 4 | 95 | 5 | 10 | 100 | brazing material | A |
| 5 | 90 | 10 | 10 | 100 | brazing material | A |
| 6 | 80 | 20 | 10 | 100 | brazing material | A |
| 7 | 60 | 40 | 10 | 100 | brazing material | A |
| 8 | 50 | 50 | 10 | 100 | brazing material | B |
| 9 | 49 | 51 | 10 | 100 | brazing material | C |
| 10 | 100 | 0 | 10 (all being CBN) | | brazing material | D |

Preparing Sample Nos. 1 to 10: A core of steel was prepared. An (Ag—Cu—Ti based) brazing material was used to fix a super-abrasive grain mixture of CBN abrasive grains and diamond abrasive grains to an outer periphery of the core. The super-abrasive grain mixture occupied 10% in area of the super-abrasive grain layer. The diamond abrasive grains had an average grain diameter of 200 μm and the CBN abrasive grains had an average grain diameter of 200 μm, and the ((diamond abrasive grains' average grain diameter)/(CBN abrasive grains' average grain diameter)) ratio was thus 100%.

Sample Nos. 1 to 10 underwent an experiment under the following conditions: Each grinding wheel was shaped to be a flat grinding wheel (FIG. 2) specified in JIS B 4140 (2006), with an outer diameter (D) of φ 200 mm, a thickness (T) of 10 mm, and a width (W) of 3 mm. A grinding experiment was conducted using a horizontal spindle surface grinding machine while supplying a water-soluble grinding solution. The workpiece was high speed steel. The grinding wheel's peripheral speed was 40 m/s, and the workpiece's speed was 10 m/min.

Result of Experiment: A period of time elapsing before the workpiece was burnt as it was ground was determined as lifetime. A column of "tool life" indicates an evaluation of each tool's lifetime. A lifetime evaluation of "A" indicates a relative lifetime of "0.8 or more" when sample No. 4 has a lifetime of "1." A lifetime evaluation of "B" indicates a relative lifetime of "less than 0.8" when sample No. 4 has a lifetime of "1." A lifetime evaluation of "C" indicates a relative lifetime of "less than 0.6" when sample No. 4 has a lifetime of "1." A lifetime evaluation of "D" indicates a relative lifetime of "less than 0.4" when sample No. 4 has a lifetime of "1."

From Table 1, it has been found that when compared with the CBN grinding wheel of sample No. 10, inclusion of diamond allows increased lifetime. It has been found that the mass ratio of the diamond abrasive grains and the CBN abrasive grains is more preferably 1:99 to 50:50, most preferably 3:97 to 40:60.

Example 2

TABLE 2

| sample nos. | superabrasive grain mixture ratio (mass %) CBN | diamond | ratio of area of superabrasive grain layer occupied by superabrasive grain mixture (%) | (diamond's average grain diameter)/(CBN's average grain diameter) (%) | type of binder | tool life |
|---|---|---|---|---|---|---|
| 11 | 99.5 | 0.5 | 30 | 98 | brazing material | C |
| 12 | 99 | 1 | 30 | 98 | brazing material | B |
| 13 | 97 | 3 | 30 | 98 | brazing material | A |
| 14 | 95 | 5 | 30 | 98 | brazing material | A |
| 15 | 90 | 10 | 30 | 98 | brazing material | A |
| 16 | 80 | 20 | 30 | 98 | brazing material | A |
| 17 | 60 | 40 | 30 | 98 | brazing material | A |
| 18 | 50 | 50 | 30 | 98 | brazing material | B |
| 19 | 49 | 51 | 30 | 98 | brazing material | C |
| 20 | 100 | 0 | 30 (all being CBN) | | brazing material | D |

Preparing Sample Nos. 11 to 20: A core of steel was prepared. An (Ag—Cu—Ti based) brazing material was used to fix a super-abrasive grain mixture of CBN abrasive grains and diamond abrasive grains to an outer periphery of the core. The super-abrasive grain mixture occupied 30% in area of the super-abrasive grain layer. The diamond abrasive grains had an average grain diameter of 196 μm and the CBN abrasive grains had an average grain diameter of 200 μm, and the ((diamond abrasive grains' average grain diameter)/(CBN abrasive grains' average grain diameter)) ratio was 98%.

Sample Nos. 11 to 20 underwent an experiment under the same conditions as sample Nos. 1-10 of example 1.

Result of Experiment: A period of time elapsing before the workpiece was burnt as it was ground was determined as lifetime. A column of "tool life" indicates an evaluation of each tool's lifetime. A lifetime evaluation of "A" indicates a relative lifetime of "0.8 or more" when sample No. 14 has a lifetime of "1." A lifetime evaluation of "B" indicates a relative lifetime of "less than 0.8" when sample No. 14 has a lifetime of "1." A lifetime evaluation of "C" indicates a relative lifetime of "less than 0.6" when sample No. 14 has a lifetime of "1." A lifetime evaluation of "D" indicates a relative lifetime of "less than 0.4" when sample No. 14 has a lifetime of "1."

From Table 2, it has been found that when compared with the CBN grinding wheel of sample No. 20, inclusion of diamond allows increased lifetime. It has been found that the mass ratio of the diamond abrasive grains and the CBN abrasive grains is more preferably 1:99 to 50:50, most preferably 3:97 to 40:60.

Example 3

TABLE 3

| sample nos. | superabrasive grain mixture ratio (mass %) CBN | diamond | ratio of area of superabrasive grain layer occupied by superabrasive grain mixture (%) | (diamond's average grain diameter)/(CBN's average grain diameter) (%) | type of binder | tool life |
|---|---|---|---|---|---|---|
| 21 | 99.5 | 0.5 | 50 | 98 | nickel plating | C |
| 22 | 99 | 1 | 50 | 98 | nickel plating | B |
| 23 | 97 | 3 | 50 | 98 | nickel plating | A |
| 24 | 95 | 5 | 50 | 98 | nickel plating | A |
| 25 | 90 | 10 | 50 | 98 | nickel plating | A |
| 26 | 80 | 20 | 50 | 98 | nickel plating | A |
| 27 | 60 | 40 | 50 | 98 | nickel plating | A |
| 28 | 50 | 50 | 50 | 98 | nickel plating | B |
| 29 | 49 | 51 | 50 | 98 | nickel plating | C |
| 30 | 100 | 0 | 50 (all being CBN) | | nickel plating | D |

Preparing Sample Nos. 21 to 30: A core of steel was prepared. Nickel plating was used to fix the above super-abrasive grain mixture of CBN abrasive grains and diamond abrasive grains to an outer periphery of the core. The super-abrasive grain mixture occupied 50% in area of the super-abrasive grain layer. The diamond abrasive grains had an average grain diameter of 196 μm and the CBN abrasive grains had an average grain diameter of 200 μm, and the ((diamond abrasive grains' average grain diameter)/(CBN abrasive grains' average grain diameter)) ratio was 98%.

Sample Nos. 21 to 30 underwent an experiment under the same conditions as sample Nos. 1-20 indicated above.

Result of Experiment: A period of time elapsing before the workpiece was burnt as it was ground was determined as lifetime. A column of "tool life" indicates an evaluation of each tool's lifetime. A lifetime evaluation of "A" indicates a relative lifetime of "0.8 or more" when sample No. 24 has a lifetime of "1." A lifetime evaluation of "B" indicates a relative lifetime of "less than 0.8" when sample No. 24 has a lifetime of "1." A lifetime evaluation of "C" indicates a relative lifetime of "less than 0.6" when sample No. 24 has a lifetime of "1." A lifetime evaluation of "D" indicates a relative lifetime of "less than 0.4" when sample No. 24 has a lifetime of "1."

From Table 3, it has been found that when compared with the CBN grinding wheel of sample No. 30, inclusion of diamond allows increased lifetime. It has been found that the mass ratio of the diamond abrasive grains and the CBN abrasive grains is more preferably 1:99 to 50:50, most preferably 3:97 to 40:60.

Example 4

TABLE 4

| sample nos. | superabrasive grain mixture ratio (mass %) CBN | diamond | ratio of area of superabrasive grain layer occupied by superabrasive grain mixture (%) | (diamond's average grain diameter)/(CBN's average grain diameter) (%) | type of binder | tool life |
|---|---|---|---|---|---|---|
| 31 | 99.5 | 0.5 | 70 | 90 | nickel plating | C |
| 32 | 99 | 1 | 70 | 90 | nickel plating | B |
| 33 | 97 | 3 | 70 | 90 | nickel plating | A |
| 34 | 95 | 5 | 70 | 90 | nickel plating | A |
| 35 | 90 | 10 | 70 | 90 | nickel plating | A |
| 36 | 80 | 20 | 70 | 90 | nickel plating | A |
| 37 | 60 | 40 | 70 | 90 | nickel plating | A |
| 38 | 50 | 50 | 70 | 90 | nickel plating | B |
| 39 | 49 | 51 | 70 | 90 | nickel plating | C |
| 40 | 100 | 0 | 70 (all being CBN) | | nickel plating | D |

Preparing Sample Nos. 31 to 40: A core of steel was prepared, and nickel plating was used to fix the above super-abrasive grain mixture of CBN abrasive grains and diamond abrasive grains to an outer periphery of the core. The super-abrasive grain mixture occupied 70% in area of the super-abrasive grain layer. The diamond abrasive grains had an average grain diameter of 180 μm and the CBN abrasive grains had an average grain diameter of 200 μm, and the ((diamond abrasive grains' average grain diameter)/(CBN abrasive grains' average grain diameter)) ratio was 90%.

Sample Nos. 31 to 40 underwent an experiment under the same conditions as sample Nos. 1-30 indicated above.

Result of Experiment: A period of time elapsing before the workpiece was burnt as it was ground was determined as lifetime. A column of "tool life" indicates an evaluation of each tool's lifetime. A lifetime evaluation of "A" indicates a relative lifetime of "0.8 or more" when sample No. 34 has a lifetime of "1." A lifetime evaluation of "B" indicates a relative lifetime of "less than 0.8" when sample No. 34 has a lifetime of "1." A lifetime evaluation of "C" indicates a relative lifetime of "less than 0.6" when sample No. 34 has a lifetime of "1." A lifetime evaluation of "D" indicates a relative lifetime of "less than 0.4" when sample No. 34 has a lifetime of "1."

From Table 4, it has been found that when compared with the CBN grinding wheel of sample No. 40, inclusion of diamond allows increased lifetime. It has been found that the mass ratio of the diamond abrasive grains and the CBN abrasive grains is more preferably 1:99 to 50:50, most preferably 3:97 to 40:60.

Example 5

TABLE 5

| sample nos. | superabrasive grain mixture ratio (mass %) CBN | diamond | ratio of area of superabrasive grain layer occupied by superabrasive grain mixture (%) | (diamond's average grain diameter)/(CBN's average grain diameter) (%) | type of binder | tool life |
|---|---|---|---|---|---|---|
| 41 | 85 | 15 | 70 | 45 | nickel plating | C |
| 42 | 85 | 15 | 70 | 48 | nickel plating | B |
| 43 | 85 | 15 | 70 | 50 | nickel plating | A |
| 44 | 85 | 15 | 70 | 60 | nickel plating | A |
| 45 | 85 | 15 | 70 | 70 | nickel plating | A |
| 46 | 85 | 15 | 70 | 80 | nickel plating | A |
| 47 | 85 | 15 | 70 | 90 | nickel plating | A |
| 48 | 85 | 15 | 70 | 100 | nickel plating | A |
| 49 | 85 | 15 | 70 | 110 | nickel plating | A |
| 50 | 100 | 0 | 70 (all being CBN) | | nickel plating | D |

Preparing Sample Nos. 41 to 50: A core of steel was prepared, and nickel plating was used to fix the above super-abrasive grain mixture of CBN abrasive grains and diamond abrasive grains to an outer periphery of the core. The super-abrasive grain mixture occupied 70% in area of the super-abrasive grain layer. The diamond abrasive grains had an average grain diameter of 90-200 μm and the CBN abrasive grains had an average grain diameter of 200 μm, and the ((diamond abrasive grains' average grain diameter)/(CBN abrasive grains' average grain diameter)) ratio was 45-110%.

Sample Nos. 41 to 50 underwent an experiment under the following conditions: Each grinding wheel was shaped to be a flat grinding wheel specified in JIS B 4140 (2006), with an outer diameter (D) of φ 300 mm, a thickness (T) of 20 mm, and a width (W) of 3 mm. A grinding experiment was conducted using a horizontal spindle grinder while supplying a water-soluble grinding solution. The workpiece was INCONEL®. The grinding wheel's peripheral speed was 50 m/s, and the workpiece's speed was 8 m/min.

Result of Experiment: A period of time elapsing before the superabrasive grain layer was worn and the grinding resistance was significantly increased, and it was thus difficult to continue to grind the workpiece, was determined as lifetime. A column of "tool life" indicates an evaluation of each tool's lifetime. A lifetime evaluation of "A" indicates a relative lifetime of "0.8 or more" when sample No. 43 has a lifetime of "1." A lifetime evaluation of "B" indicates a relative lifetime of "less than 0.8" when sample No. 43 has a lifetime of "1." A lifetime evaluation of "C" indicates a relative lifetime of "less than 0.6" when sample No. 43 has a lifetime of "1." A lifetime evaluation of "D" indicates a relative lifetime of "less than 0.4" when sample No. 43 has a lifetime of "1."

From Table 5, it has been found that when compared with the CBN grinding wheel of sample No. 50, inclusion of diamond allows increased lifetime. The average grain diameter ratio of the diamond abrasive grains and the CBN abrasive grains is more preferably 48% or more and 110% or less, most preferably 50% or more and 110% or less.

Example 6

TABLE 6

| sample nos. | superabrasive grain mixture ratio (mass %) CBN | diamond | ratio of area of superabrasive grain layer occupied by superabrasive grain mixture (%) | (diamond's average grain diameter)/(CBN's average grain diameter) (%) | type of binder | tool life |
|---|---|---|---|---|---|---|
| 61 | 99.5 | 0.5 | 70 | 90 | nickel plating | D |
| 62 | 99 | 1 | 70 | 90 | nickel plating | C |
| 63 | 97 | 3 | 70 | 90 | nickel plating | A |
| 64 | 95 | 5 | 70 | 90 | nickel plating | A |
| 65 | 90 | 10 | 70 | 90 | nickel plating | A |
| 66 | 80 | 20 | 70 | 90 | nickel plating | A |
| 67 | 70 | 30 | 70 | 90 | nickel plating | A |
| 68 | 60 | 40 | 70 | 90 | nickel plating | B |
| 69 | 50 | 50 | 70 | 90 | nickel plating | C |
| 70 | 49 | 51 | 70 | 90 | nickel plating | D |

Preparing Sample Nos. 61 to 70: A core of steel was prepared, and nickel plating was used to fix the above super-abrasive grain mixture of CBN abrasive grains and diamond abrasive grains to an outer periphery of the core. The super-abrasive grain mixture occupied 70% in area of the super-abrasive grain layer. The diamond abrasive grains had an average grain diameter of 180 μm and the CBN abrasive grains had an average grain diameter of 200 μm, and the ((diamond abrasive grains' average grain diameter)/(CBN abrasive grains' average grain diameter)) ratio was 90%.

Sample Nos. 61 to 70 underwent an experiment under the following conditions: Each grinding wheel was shaped to be a flat grinding wheel (see FIG. 2) specified in JIS B 4140 (2006), with an outer diameter (D) of φ 200 mm, a thickness (T) of 10 mm, and a width (W) of 3 mm. A grinding experiment was conducted using a horizontal spindle grinder while supplying a water-soluble grinding solution. The workpiece was high speed steel. The grinding wheel's peripheral speed was 40 m/s, and the workpiece's speed was 13 m/min. That is, the workpiece's speed is 30% higher than that in Example 1 and hence a severe grinding condition.

Result of Experiment: A period of time elapsing before the workpiece was burnt as it was ground was determined as lifetime. A column of "tool life" indicates an evaluation of each tool's lifetime. A lifetime evaluation of "A" indicates a relative lifetime of "0.8 or more" when sample No. 63 has a lifetime of "1." A lifetime evaluation of "B" indicates a relative lifetime of "less than 0.8" when sample No. 63 has a lifetime of "1." A lifetime evaluation of "C" indicates a relative lifetime of "less than 0.6" when sample No. 63 has a lifetime of "1." A lifetime evaluation of "D" indicates a relative lifetime of "less than 0.4" when sample No. 63 has a lifetime of "1."

From Table 6, it has been found that the mass ratio of the diamond abrasive grains and the CBN abrasive grains is most preferably 3:97 to 30:70.

Example 7

TABLE 7

| sample nos. | superabrasive grain mixture ratio (mass %) CBN | diamond | ratio of area of superabrasive grain layer occupied by superabrasive grain mixture (%) | (diamond's average grain diameter)/(CBN's average grain diameter) (%) | type of binder | tool life |
|---|---|---|---|---|---|---|
| 81 | 85 | 15 | 70 | 45 | nickel plating | D |
| 82 | 85 | 15 | 70 | 48 | nickel plating | D |
| 83 | 85 | 15 | 70 | 50 | nickel plating | C |
| 84 | 85 | 15 | 70 | 60 | nickel plating | C |
| 85 | 85 | 15 | 70 | 70 | nickel plating | B |
| 86 | 85 | 15 | 70 | 80 | nickel plating | A |
| 87 | 85 | 15 | 70 | 90 | nickel plating | A |
| 88 | 85 | 15 | 70 | 100 | nickel plating | A |
| 89 | 85 | 15 | 70 | 110 | nickel plating | A |

Preparing Sample Nos. 81 to 89: A core of steel was prepared, and nickel plating was used to fix the above super-abrasive grain mixture of CBN abrasive grains and diamond abrasive grains to an outer periphery of the core. The super-abrasive grain mixture occupied 70% in area of the super-abrasive grain layer. The diamond abrasive grains had an average grain diameter of 90-200 μm and the CBN abrasive grains had an average grain diameter of 200 μm, and the ((diamond abrasive grains' average grain diameter)/(CBN abrasive grains' average grain diameter)) ratio was 45-110%.

Sample Nos. 81 to 90 underwent an experiment under the following conditions: Each grinding wheel was shaped to be a flat grinding wheel specified in JIS B 4140 (2006), with an outer diameter (D) of φ 300 mm, a thickness (T) of 20 mm, and a width (W) of 3 mm. A grinding experiment was conducted using a horizontal spindle grinder while supplying a water-soluble grinding solution. The workpiece was INCONEL®. The grinding wheel's peripheral speed was 50 m/s, and the workpiece's speed was 10.5 m/min. That is, the workpiece's speed is 30% higher than that in Example 5 and hence a severe grinding condition.

Result of Experiment: A period of time elapsing before the superabrasive grain layer was worn and the grinding resistance was significantly increased, and it was thus difficult to continue to grind the workpiece, was determined as lifetime. A column of "tool life" indicates an evaluation of each tool's lifetime. A lifetime evaluation of "A" indicates a relative lifetime of "0.8 or more" when sample No. 86 has a lifetime of "1." A lifetime evaluation of "B" indicates a relative lifetime of "less than 0.8" when sample No. 86 has a lifetime of "1." A lifetime evaluation of "C" indicates a relative lifetime of "less than 0.6" when sample No. 86 has a lifetime of "1." A lifetime evaluation of "D" indicates a relative lifetime of "less than 0.4" when sample No. 86 has a lifetime of "1."

From Table 7, it has been found that the average grain diameter ratio of the diamond abrasive grains and the CBN abrasive grains is most preferably 80% or more and 110% or less.

It should be understood that the embodiments and examples disclosed herein have been described for the purpose of illustration only and in a non-restrictive manner in any respect. The scope of the present invention is defined by the terms of the claims, rather than the embodiments described above, and is intended to include any modifications within the meaning and scope equivalent to the terms of the claims.

REFERENCE SIGNS LIST

1: super-abrasive grinding wheel; 10: core; 15: super-abrasive grain layer; 20: diamond abrasive grain; 30: CBN abrasive grain; 40: binder.

The invention claimed is:

1. A super-abrasive grinding wheel comprising:

a core; and a super-abrasive grain layer provided on a surface of the core, the super-abrasive grain layer including diamond abrasive grains and CBN abrasive grains, the diamond abrasive grains and the CBN abrasive grains being fixed to the core in a single layer by a binder including metal-plating or a brazing material, wherein the diamond abrasive grains and the CBN abrasive grains have an average grain diameter ratio ((the diamond abrasive grains' average grain diameter)/(the CBN abrasive grains' average grain diameter)) of 50% to 110%, the diamond abrasive grains average grain diameter and the CBN abrasive grains' average grain diameter are larger than a thickness of the binder, and the diamond abrasive grains and the CBN abrasive grains occupy 10% to 70% in area of the super-abrasive grain layer.

2. The super-abrasive grinding wheel according to claim 1, wherein the diamond abrasive grains and the CBN abrasive grains have a mass ratio of 1:99 to 50:50.

3. The super-abrasive grinding wheel according to claim 2, wherein the diamond abrasive grains and the CBN abrasive grains have a mass ratio of 3:97 to 40:60.

4. The super-abrasive grinding wheel according to claim 3, wherein the diamond abrasive grains and the CBN abrasive grains have a mass ratio of 3:97 to 30:70.

5. The super-abrasive grinding wheel according to claim 1, wherein the binder is a brazing material or metal-plating.

6. The super-abrasive grinding wheel according to claim 1, wherein the diamond abrasive grains and the CBN abrasive grains have an average grain diameter ratio ((the diamond abrasive grains' average grain diameter)/(the CBN abrasive grains' average grain diameter)) of 80% to 110%.

* * * * *